United States Patent [19]

Hanna

[11] 4,385,460

[45] May 31, 1983

[54] PHONORECORD LABEL

[76] Inventor: Richard D. Hanna, 115 Prospect St., Framingham, Mass. 01701

[21] Appl. No.: 236,326

[22] Filed: Feb. 20, 1981

[51] Int. Cl.[3] ..... G09F 3/00

[52] U.S. Cl. ..... 40/340; 40/2 R

[58] Field of Search ..... 40/340, 2 R, 306, 307, 40/310, 312, 324, 337

[56] References Cited

U.S. PATENT DOCUMENTS

| | | | |
|---|---|---|---|
| 388,012 | 8/1988 | Beers | 283/63 R |
| 1,198,891 | 9/1916 | Chormann | 40/340 |
| 1,434,005 | 10/1922 | Gulyban | 40/340 |
| 1,489,147 | 4/1924 | Padgett | 40/340 |
| 2,202,925 | 6/1940 | Schoch | 369/289 |
| 2,346,219 | 4/1944 | Johnson | 40/2 R |
| 2,353,369 | 7/1944 | Sears | 40/340 |
| 3,197,899 | 8/1965 | Twentier | 40/2 R |
| 3,422,558 | 1/1969 | Fee | 40/306 |
| 3,484,976 | 12/1969 | Shea | 40/310 |
| 3,486,257 | 12/1969 | Walldorf | 40/2 R |
| 3,500,364 | 3/1970 | David et al. | 360/133 |
| 3,726,030 | 4/1973 | Wilson | 40/2 R |
| 4,128,954 | 12/1978 | White | 40/310 |
| 4,204,706 | 5/1980 | Blum | 40/2 R |

FOREIGN PATENT DOCUMENTS

| | | | |
|---|---|---|---|
| 1452573 | 10/1966 | France | 40/340 |

*Primary Examiner*—Gene Mancene
*Assistant Examiner*—John J. Wilson
*Attorney, Agent, or Firm*—Lahive & Cockfield

[57] ABSTRACT

A phonorecord greeting label, for application to a recording by a consumer, adheres to and overlies the manufacturer's label. The new label has a transparent mounting element and has a message element hingedly mounted thereto. Both faces of the message element are accessible for reading, and the manufacturer's label underneath it can be read.

3 Claims, 7 Drawing Figures

PHONORECORD LABEL

BACKGROUND OF THE INVENTION

This invention provides a new article of commerce in the form of a label which a purchaser or other consumer of a phonorecord or other recording can apply directly to the recording and yet which leaves the entirety of the manufacturer's label accessible for reading.

One use of the new label is to affix a greeting message to a phonograph record that is given as a gift. Another use is to enable the record owner to note on the record information such as purchase price and date, dates the record is played, and the like. The new label provides one or more message surfaces carried directly on the record for these and like uses essentially without any obliteration of the manufacturer's label.

The invention is described principally with reference to phonograph records, but features of the invention apply to other recordings including those in magnetic tape cassette format and on magnetic discs.

A phonograph record conventionally has a circular manufacturer's label affixed at the center of the record and centrally apertured by the spindle-receiving hole. There is no space on the record for additional labeling by the user, and it is unsatisfactory to obliterate the manufacturer's label with such additional labeling.

It is accordingly an object of this invention to provide an additional recording label which leaves the manufacturer's label intact and accessible for examination.

A further object of the invention is to provide a recording label for application by the consumer and which does not interfere with the use of the recording.

Another object is to provide a recording label of the above character which can be removed without damage to the manufacturer's label.

Other objects of the invention will in part be obvious and will in part appear hereinafter.

SUMMARY OF THE INVENTION

A recording label according to the invention has a mounting element supportingly joined to a message element. The two elements together are configured to overlie the manufacturer's label on the recording. The mounting element carries a pressure-sensitive adhesive for securing the label directly onto the manufacturer's label, but is transparent to allow full examination of the manufacturer's label which it overlies. The message element of the label is essentially a flap extending from the mounting element and which normally lies flat over the manufacturer's label. The message element can, however, be lifted for examination of the underside and for examination of the information on the underlying part of the manufacturer's label. Thus, although the two label elements overlie the manufacturer's label for ready viewing whenever the recording is used, each affords complete reading and other examination of that part of the manufacturer's label which it overlies.

In one use of the new label, a record purchaser writes a gift message on the message element and affixes the label to a phonorecording that is to be given as a gift. The user can even affix a photograph to the message element. Other uses of the new label, when affixed to a recording, include noting information about the recorded material, and about the purchase and use of the record.

A supplemental label of this character, when affixed to either a recording disc or a cassette of magnetic recording tape, remains essentially flat against the surface which bears the manufacturer's label so as not to interfere with storage or record use, e.g. playback. The user of the record, however, can examine and read the entire manufacturer's label, directly through the transparent mounting element of the new label and by lifting the message element to examine the manufacturer's label information underneath. It will also be apparent that both surfaces of the message element of the new label can bear a message or other visual information.

In one preferred practice, the new label has the same configuration as a manufacturer's phonorecording label and is of substantially the same size to cover essentially the entirety of themanufacturer's label. The new label hence can have an attractive appearance when affixed to a phonorecording. The preferred new label for use on a phonograph record thus is a circular disc of essentially the same size as the disc-shaped manufacturer's label and is centrally apertured for passage of a record-player spindle. The message and mounting elements of the new label are complimentary circular segments, i.e. together they form a complete circular disc, and the boundary between them is a chord of the circle. The new label can have a like configuration for use on a magnetic or an optical recording disc. In an alternative embodiment for use on a cassette of magnetic recording tape, the label has the same rectangular configuaration and size as the manufacturer's label. The boundary between the mounting element and the message element is again a straight line extending between two edges of the overall configuration.

The invention accordingly comprises an article of manufacture possessing the features, properties and the relation of elements exemplified in the article hereinafter described, and the scope of the invention is indicated in the claims.

For a fuller understanding of the nature and objects of the invention, reference should be made to the following detailed description and the accompanying drawings, in which:

BRIEF DESCRIPTION OF DRAWINGS

FIG . 5 is a view similar to FIG. 4 of another greeting label construction according to the invention.

DESCRIPTION OF ILLUSTRATED EMBODIMENTS

Figure 1:
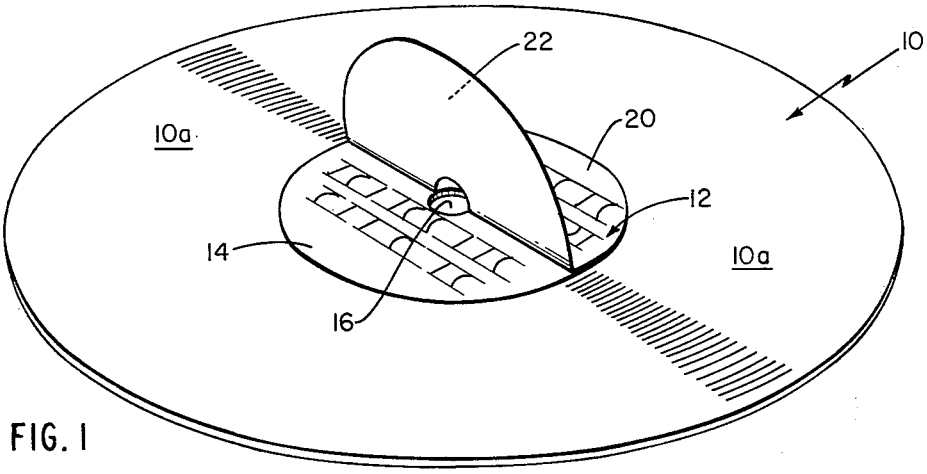
FIG. 1 shows a phonograph record bearing a greeting label embodying features of the invention.

FIG. 1 shows a conventional phonograph record 10 with a label 12 according to the invention affixed directly over the manufacturer's label 14. The annular portion 10*a* of the record is pressed to form circumferential grooves bearing in conventional manner the recorded information. The invention also can be practiced with a disc-like record that stores information with other recording techniques, i.e. it can be a magnetic recording disc or an optical memory disc.

Figure 2:
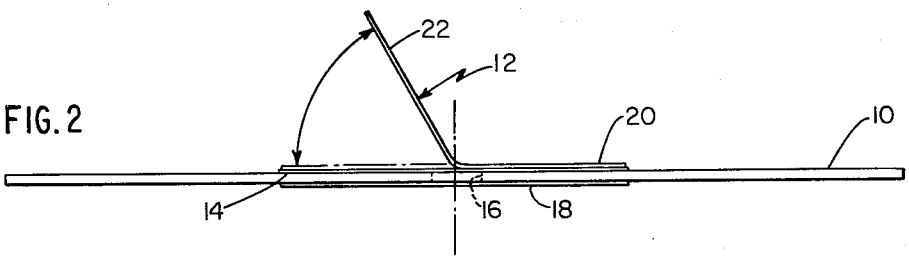
FIG. 2 is a side elevation view of the phonograph record and greeting label of FIG. 1.

The manufacturer's label 14 is the conventional circular disc affixed to a face of the record at the center and centrally apertured with a spindle-receiving hole 16 which passes entirely through the record 10. The record 10 bears an identical manufacturer's label 18 on the oposite face, as FIG. 2 shows.

Figure 3:
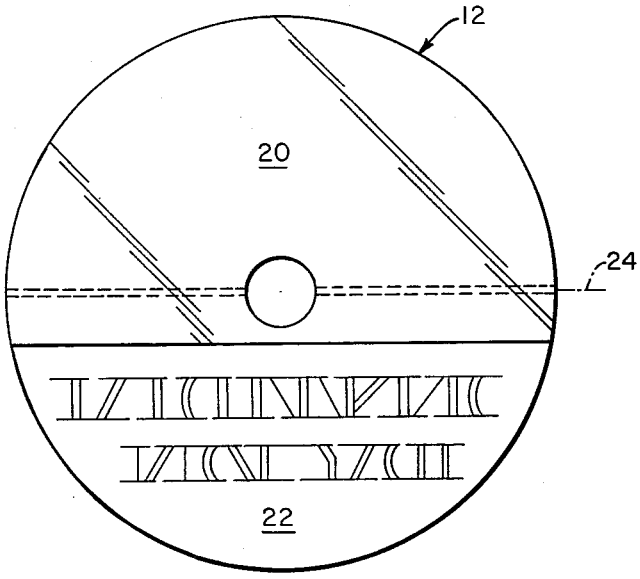
FIG. 3 is a plan view of the greeting label shown in FIGS. 1 and 2.

The illustrated new label 12 is a sheet-like circular disc formed with a transparent mounting element 20 supportingly joined to a message element 22. The two portions are circular segments that together form the complete circular disc. In the preferred form shown, the label 12 is identical in shape and in peripheral dimensions to the disc-shaped manufacturer's label 14 to attain an attractive assemblage of the new label 12 in exact registration over the manufacturer's label 14, except when the message element 22 is lifted from the plane of the record 10, as appears in the solid showing in FIGS. 1 and 2. The mounting element 20 is, as stated, transparent and is adhered to the manufacturer's label 14, typically with a pressure-sensitive adhesive as discussed further below. The message element 22 joins to the mounting portion along a chord of the disc-like configuration. In the embodiment of FIGS. 1 through 4, the chord is a diameter 24 (FIG. 3). Both elements are of thin sheet or paper-like stock. The mounting element typically uses material common in pressure-sensitive transparent adhesive tape and the material of the message element 22 is, for example, high grade paper stock or thin plastic sheet stock with frosted surfaces on which one can readily write information and, where desired, adhesively mount photographs or pictures. Further, the message element can receive writing or other information on both faces.

Figure 4:
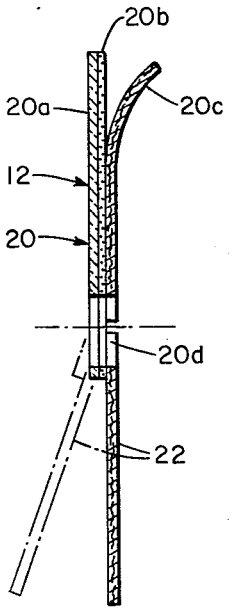
FIG. 4 is a cross-sectional view, with thickness dimensions enlarged for clarity, of the greeting label shown in FIG. 3.

FIG. 4 shows one construction for the label 12 with a mounting element 20 of transparent plastic film **20*a* coated with a layer 20*b* of pressure-sensitive adhesive that carries a removable protective peel-off film 20*c*. The mounting element forms a major circular segment of the label but the peel-off film 20*c* is of smaller size, i.e. is semicircular. This leaves the adhesive layer 20*b* uncovered along a joining strip 20*d* extending along the chord 24. The message element 22 is a card-like panel of writing stock, typically paper-based or plastic-based, that is semicircular and adhered to the mounting element by way of the adhesive layer 20*b* along the joining strip 20*d***.

With this construction, the mounting element 20 can adhere the label 12 to a one-half or semicircular portion of the manufacturer's label 14 (FIG. 1) to affix the semicircular message element to the record 10. The latter element can lie flat over the remaining half of the manufacturer's label during use and storage of the record. The hinged mounting of the message element 22 allows a user to lift the message element from the record surface and thereby allow one to read the underside of the message element as well as the portion of the manufacturer's label which it otherwise overlies.

Figure 5:
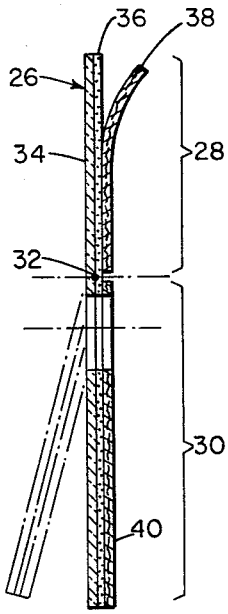

FIG. 5 shows a cross-sectional view like FIG. 4 of another construction of a label 26 according to the invention and having a mounting element 28 and a message element 30. Where the label 26 is a circular disc, like the label 12 of FIGS. 1 through 4, the juncture between the two elements is at a chord 32. A transparent disc-shaped sheet 34 has the same peripheral dimensions as the label 26 and carries a pressure-sensitive layer of adhesive 36 over the entire inner surface, i.e. the right facing surface in FIG. 5. A removable protective peel-off film 38 covers the adhesive 36 over the mounting element 28. The message element 30, however, has a writing panel 40 adhered to the adhesive 36.

With this construction, the transparent sheet 34 forms the entire outer, left-facing in FIG. 5, surface of the label 26. The exposed surface of this sheet can be treated to receive writing or other user-applied information, particularly throughout the message element of the label. The opposing surface of the label 26 throughout the message element is formed by the writing panel 40.

It will be apparent to those skilled in the art that the new label of the invention can be fabricated with construction other than those illustrated. Where the adhesive for affixing the mounting element to a record is of the commercially available removable type, one can remove the label 12 or the label 26 from a record, where that becomes desirable, without damage to the underlying manufacturer's label. It will also be understood that although the illustrated embodiments of the invention are of circular disc-like configuration to conform to the manufacturer's label on a conventional phonograph record, the new label can employ other geometries including an essentially rectangular format to conform to the manufacturer's label on a conventional cassette of magnetic recording tape.

Figure 6:
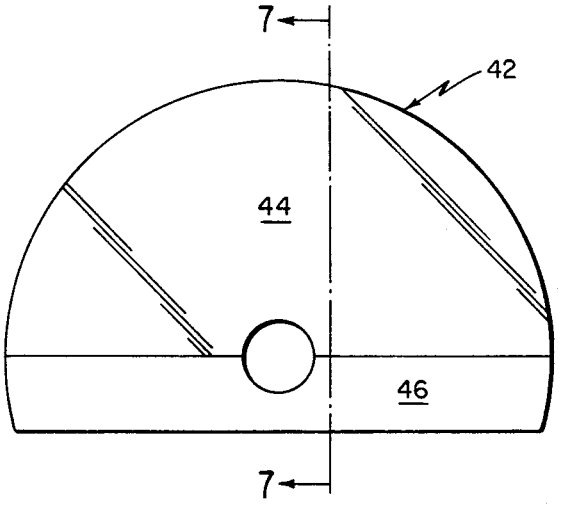
FIGS. 6 and 7 are views similar to FIGS. 3 and 4 of another embodiment.
Figure 7:
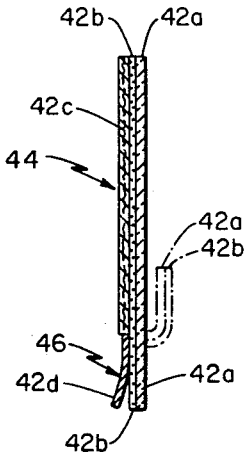

Another embodiment of the invention is a label ecured by a mounting portion that folds underneath the message portion. For a phonograph record, this label 42 can have, as FIGS. 6 and 7 show, a semicircular message portion 44 from which a mounting portion 46 extends. The illustrated label 42 has a transparent layer **42*a* coated with adhesive 42*b* and carrying a decorative panel 42*c* on the front face of the message portion. A peel-off film 42*d* is over the adhesive. The label 42 is mounted by folding the message portion 46 180° from the extended position shown to underlie the message portion 44, as shown with broken lines in FIG. 7. After removal of the film 42*d***, the adhesive is exposed for mounting on a record surface.

It will thus be seen that the objects set forth above, among those made apparent from the preceding description, are efficiently attained. Since certain changes mwy be made in the above recording label without departing from the scope of the invention, it is intended that all matter contained in the above description or shown in the accompanying drawing be interpreted as illustrative and not in a limiting sense.

It is also to be understood that the following claims are intended to cover all of the generic and specific features of the invention described herein, and all statements of the scope of the invention which as a matter of language might be said to fall therebetween.

Having described the invention, what is claimed as new and secured by Letters Patent is:

1. A label for consumer application to a recording, said label being characterized in that it is configured to adhere to and overlie a manufacturer's record label while leaving that label accessible for examination and comprises a mounting element hingedly mounting a message element thereof, said mounting element being transparent and sheet-like and having opposed first and second surfaces and having a label-mounting adhesive layer carried on said second surface and further having a removable protective film covering said adhesive layer, said message element being sheet-like with opposed third and fourth surfaces and joined to said mounting element for normally overlying the manufacturer's label to which said mounting element is adhered, and being repeatedly liftable from the manufacturer's label as a hingedly mounted flap for visual examination of the message element underside and of the manufacturer's label therebelow, and being further arranged for bearing consumer-applied information on at least one said surface thereof, and said message element and said mounting element together forming a sheet-like label having a circular outer periphery with a diameter not greater than the diameter of a manufacturer's record label and with a central spindle-receiving hole therethrough.

2. A label according to claim 1 further characterized in that each element forms a segment of said circular configuration.

3. A label according to claim 1 further characterized in that said label message element forms a semicircular segment of said circular configuration.

* * * * *